United States Patent [19]

Metcalfe et al.

[11] 4,172,905

[45] Oct. 30, 1979

[54] TRANSFERRING XEROGRAPHIC IMAGES

[75] Inventors: Kenneth A. Metcalfe, Lockleys; Alwin S. Clements, Largs Bay; Brian J. Horrocks, Salisbury, all of Australia

[73] Assignee: The Commonwealth of Australia, Canberra, Australia

[21] Appl. No.: 434,563

[22] Filed: Jan. 18, 1974

[30] Foreign Application Priority Data

Jan. 26, 1973 [AU] Australia ..... PB2038

[51] Int. Cl.[2] ..... G03G 13/16; G03G 15/16

[52] U.S. Cl. ..... 427/24; 96/1.4; 355/3 TR; 361/225; 427/16

[58] Field of Search ..... 117/17.5, 37 LE; 96/1 SD, 1.4, 1 LY, 1 C; 118/637, DIG. 23; 427/24, 39, 16; 361/225; 355/3 TR, 3 CH

[56] References Cited

U.S. PATENT DOCUMENTS

| | | | |
|---|---|---|---|
| 2,901,374 | 8/1959 | Gundlach | 117/17.5 |
| 2,951,443 | 9/1960 | Byrne | 101/426 |
| 3,003,404 | 10/1961 | Metcalfe et al. | 117/37 LE |
| 3,013,890 | 12/1961 | Bixby | 117/17.5 |
| 3,658,519 | 4/1972 | Menz | 117/17.5 |
| 3,706,553 | 12/1972 | Menz | 117/17.5 |
| 3,764,207 | 10/1973 | Obuchi | 355/3 TR |
| 3,781,105 | 12/1973 | Meacher | 117/17.5 |

*Primary Examiner*—Ronald H. Smith
*Assistant Examiner*—Stuart D. Frenkel
*Attorney, Agent, or Firm*—Haseltine, Lake & Waters

[57] ABSTRACT

A method of transferring images from one surface to another, which, instead of using a steady field uses a corona to build up a charge on a roller which transfers the charge to the surface where transfer is required. The device comprises a pair of rollers which are urged toward each other, one of the rollers having an insulator surface, the other roller forming an electrode, the charge being applied to the insulator surface on the one roller by means of a corona generating device spaced from the insulator surface and remote from the electrode roller.

3 Claims, 1 Drawing Figure

TRANSFERRING XEROGRAPHIC IMAGES

This invention relates to improvements in and to the transfer of electrostatic images.

BACKGROUND OF THE INVENTION

There are many occasions where it is desirable to transfer images produced by electrostatic means to another surface.

One such requirement is that where an image is produced on a sheet or membrane containing a photoconductor and it is to be transferred to a sheet of paper or the like so that the sheet containing the photoconductor can be reused after cleaning or for the purpose of ensuring that the final copy is on plain paper and does not contain a photoconductive layer.

It will be known that there are many applications where the final image produced, for instance, by wet xerographic development methods shall be on a plain surface without any photoconductor and many ways of transferring such images have been proposed heretofore but which generally comprise bringing the photoconductive surface on which the image has been developed into contact with the receiving sheet on to which the image is to be transferred and applying pressure to cause the image to transfer.

It is also known to use a field to aid this transfer and according to such a method the two sheets may be passed between a pair of rollers which have a potential applied between them of a polarity such that the marking particles from the photoconductor sheet will be forced away from this sheet and into firm contact with the surface on which the final image is to appear and while such transfers, particularly where a biasing field is used to aid the transfer, as well as pressure, are quite satisfactory under many conditions, such methods as known heretofore generally have the disadvantage that the transfer is either only of a small proportion of the original image or the transfer can be subject to some amount of loss of definition due to the pressure applied or to the particular field used at the time and generally a really high quality transferred image may not be achieved.

SUMMARY OF THE INVENTION

It is an object of the present invention to provide an improved form of transfer device and method of use which will enhance the transfer of an image from one surface to another such as from a photoconductive sheet to a plain sheet of paper, and moreover to achieve this in a simple and effective manner with a minimal loss of definition of the image.

According to our invention the method of transferring an image from one membrane to another, such as a sheet having a photoconductive surface on which an image has been developed by wet xerography, to a plain piece of paper which forms the final receiving sheet is effected by using a pair of pressure rollers between which the sheets are passed with the image on the one sheet in contact with that surface of the other sheet which is to receive the image, but instead of applying a field between two such rollers which in that case are conductive, a corona discharge is used to charge an insulator surface on one of the rollers while the other roller forms the return for the charging system.

We have found for instance, that if a conductive roller is grounded and this is in contact with a conductive roller which however has a sleeve of insulator material around it, that this sleeve can receive a high level charge by positioning some distance from this insulator roller and on the opposite side from the grounded roller, a series of corona points which are directed towards the insulator roller, and applying to these corona points a relatively high voltage to cause the points to omit corona discharges which then have the effect of charging the surface on the insulator roller.

While not wishing to be bound to any specific theory regarding the operation of the invention, it should be remembered that when a pair of rollers of a conductive nature, even if one has a semiconductive coating, are used as a pressure means for a pair of membranes from one of which to the other a transfer is to take place, the field between the rollers is generated by the application of a potential between the rollers, and even if high voltages are used under such conditions, and even assuming that the roller with the semiconductive surface on it has a high potential applied to it, there is nevertheless no direct charging of the outer surface of the roller to provide a field at the point of contact of the rollers, assuming there is a layer or layers of paper or the like between them, and while a field does exist, it is not as effective as the field provided according to our invention.

When a corona discharge which can be in the nature of a multiplicity of points arranged on a suitable support, or charging wires within shields as those known under the Trade name of "Korotron," are used some distance from an insulator roller, there will be a flow of current from the corona discharge points or wires to the insulator surface, provided it is interposed between the corona device and the return electrode, the effect being to charge the surface of the insulator with gas ions resulting from the corona and these gas ions are then carried around during the rotation of the roller as the master sheet and the transfer receiving sheet are passed between the now charged roller and the other roller to provide, at the nip of the rollers, a strong field which will move the image from the one surface to the other in a highly effective manner.

It will be realized that by utilizing the present invention it is possible to attain a very high charge on the insulator roller, and as the corona is applied externally from some distance away from the roller, a very uniform charge will exist over the whole of the surface of the roller, which naturally will be applied at the point nearest to the corona discharge means but will remain on the surface of the insulated sleeve, or the like, on the roller and will carry around with this to flow down to the point of proximity of the insulator roller with the grounded roller to effect the necessary transfer.

According to this invention, it is also possible to enhance the effect by using a gas other than air as the discharge means for the corona and in this way the type of gas ion which collects on the insulated roller can be varied to suit differing conditions, but generally air is found to be quite a satisfactory medium to build up a layer of gas ions on the insulator surface of the roller.

So far as the developer is concerned which has been found to be highly effective in such a transfer system, it can be mentioned that a liquid developer consisting of a semiconductive marking medium suspended in an insulating carrier liquid, applied to a photoconductive surface according to any of the known methods of imaging, can readily be transferred to paper or any other surface by the use of a field resulting from a corona which places a gas ion layer on the insulator roller, the system resulting in highly improved transfer with high resolution.

DESCRIPTION OF A PREFERRED EMBODIMENT

Figure 1:
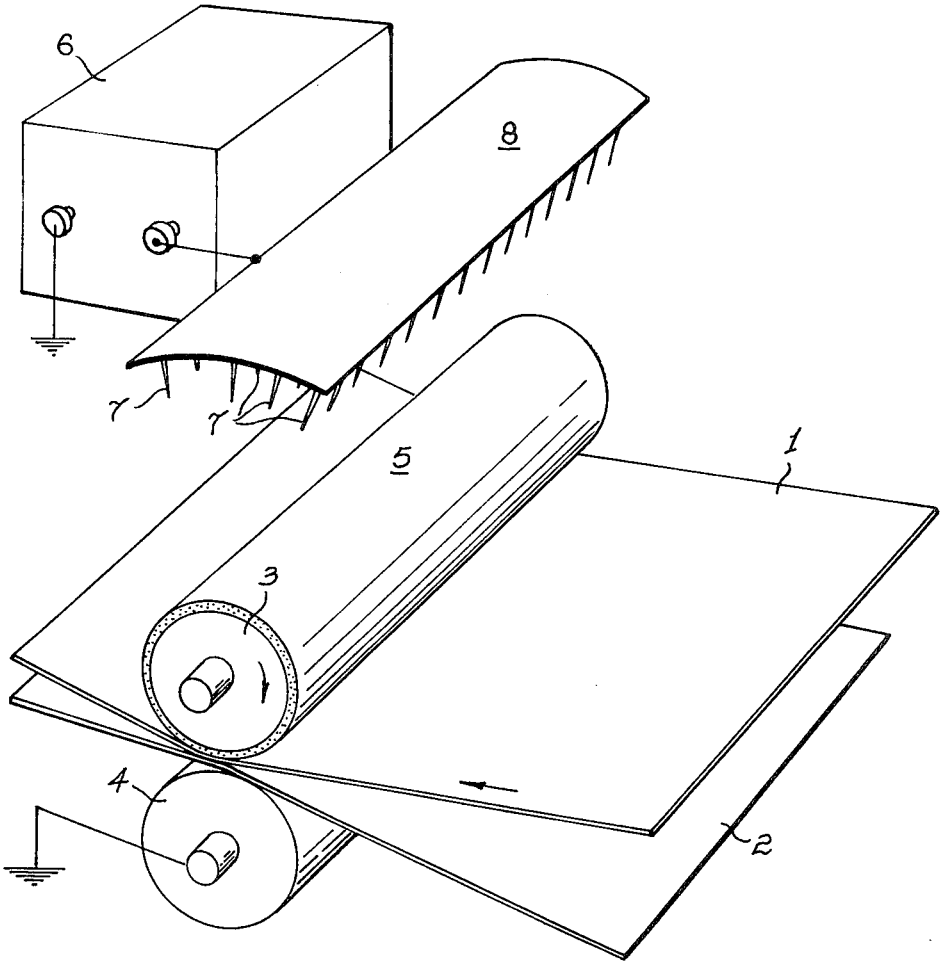

The following description is made of a preferred embodiment to which the invention is not to be limited but which is given merely to show a convenient manner in which the invention can be carried into effect.

In the sole FIGURE of the drawing designated FIG. 1 the master sheet 2 carries a transferable image on that surface which is adjacent to the image receiving sheet 1 and these two sheets are passed between rollers 3 and 4, the roller 3 having an external sleeve 5 of a material which is a relatively high insulator, the roller 4 being a metal roller or formed of other conductive media and being grounded as shown, to form an electrode.

A high voltage device 6 generates a corona voltage so that a corona discharge takes place from each of the points 7 which are attached to the metal backing plate 8, the points 7 together with the metal backing plate 8 forming the other electrode for the system. The points 7 are directed towards the insulator roller 3 so that a corona discharge will take place from the points 7 to the insulator coating 5 of the roller 3. The roller 4 and the high voltage producing device 6 and grounded to complete the circuit. The roller 3 is interposed between points 7 and roller 4 and is ungrounded as shown in FIG. 1.

Since the roller 3 is interposed between the upper electrode 7-8 and the lower electrode 4, the result of this is that when a high voltage is applied between these electrodes, the corona discharge causes a relatively high charge to be built up on the insulating layer 5 on the roller 3 and this charge will be carried around by the roller to the nip between the rollers 3 and 4 to provide the field which then causes transfer of the image from sheet 2 to sheet 1.

It will be realized that if an attempt were made to use a corona discharge as the means for transferring, the effect would not be the same because the intermediate roller between the two electrodes, that is the corona producing points and the lower roller, has the effect of collecting the result of the corona discharge, that is the gas ions flowing from the corona electrode and holding these on the insulating surface so that a very heavy charge can be built up on the surface of these gas ions and these are then concentrated in their action at the nip between the rollers.

In other words a large area of surface of the insulating roller is subjected to a corona discharge to allow a substantial charge to be built up on the insulator, but this is applied to effect the transfer only at what is practically line contact at the nip of the rollers.

The following example indicates how the invention may be applied.

A metal roller of 38 millimeters diameter has on it a sleeve of Polyester Film having a thickness of 2 millimeters. In place of this an anodized aluminum roller can be used having its oxide coating about 10 microns thick.

Spaced at a distance of 22 millimeters from this roller are the discharge points which project from the plate to which the corona forming voltage is applied, this voltage typically being 5 kilovolts.

A pressure of about 4 kilograms per meter is applied between the rollers.

We claim:

1. A method of transferring images from one surface to another which comprises,
   (a) positioning a sheet containing a transferrable image on to a receiving sheet with the image in contact with the said receiving sheet,
   (b) passing said sheets simultaneously while in contact between a pair of rollers which are urged toward each other, one of said rollers being ungrounded and having an insulator surface and the other of said rollers being a grounded conductive roller,
   (c) applying a charge between a corona discharge device and said conductive roller through said insulator roller by disposing said corona device on the opposite side of said insulator roller in relation to the conductive roller whereby said insulator roller shields said conductive roller from said corona discharge device and said insulating roller receives and holds a charge from said corona discharge device, at least part of said charge flowing between said rollers through said sheets substantially at the nip between said rollers, and
   (d) selecting the transfer polarity to transfer at least part of the said transferrable image to the said transfer sheet.

2. Apparatus for transferring xerographic images comprising; a pair of rollers urged together, one of said rollers being ungrounded and having an insulator surface, the other being a conductive roller which is grounded, a corona discharge device positioned remotely from the said insulator roller generally oppositely from the conductive roller and nearer to the insulator roller, and a grounded high voltage generating device connected to the said corona discharge device to impress a corona voltage forming between the discharge device and the grounded roller, whereby a high voltage charge is generated on said insulator roller which is interposed between the corona discharge device and the grounded roller which charge can be dissipated to the said conductive roller at the nip of the rollers such that a strong transfer field is generated thereat.

3. Apparatus as claimed in claim 2 wherein said corona discharge device, said insulator roller and said conductive roller are arranged in a substantially linear array in the order given so that the insulator roller intercepts the voltage discharge between the discharge device and the grounded conductive roller to build up the charge on the insulator roller.

* * * * *